US007628424B2

(12) United States Patent
Seidl et al.

(10) Patent No.: US 7,628,424 B2
(45) Date of Patent: Dec. 8, 2009

(54) TRENCHING MACHINE WITH LINKED CHAIN

(75) Inventors: Jeff Seidl, Seymour, WI (US); Troy Ullmer, Seymour, WI (US)

(73) Assignee: Innerworx, LLC, Seymour, WI (US)

( * ) Notice: Subject to any disclaimer, the term of this patent is extended or adjusted under 35 U.S.C. 154(b) by 124 days.

(21) Appl. No.: 11/953,642

(22) Filed: Dec. 10, 2007

(65) Prior Publication Data

US 2008/0163523 A1 Jul. 10, 2008

Related U.S. Application Data

(60) Provisional application No. 60/869,225, filed on Dec. 8, 2006.

(51) Int. Cl.
*E02F 3/14* (2006.01)

(52) U.S. Cl. ..... 280/762; 37/352; 37/465

(58) Field of Classification Search ..... 280/762; 37/190, 352, 462, 463, 464, 465
See application file for complete search history.

(56) References Cited

U.S. PATENT DOCUMENTS

| | | | | |
|---|---|---|---|---|
| 1,528,546 | A | 3/1925 | Holmes | |
| 1,687,845 | A | 10/1928 | Nachenius | |
| 2,189,669 | A | 2/1940 | Lewis | |
| 2,190,000 | A | 2/1940 | Stenger | |
| 2,594,990 | A | 4/1952 | Protzeller | |
| 2,650,812 | A | 9/1953 | Harris | |
| 2,650,813 | A | 9/1953 | Rollins | |
| 2,666,273 | A * | 1/1954 | McIninch | 37/352 |
| 3,049,824 | A | 8/1962 | Mclninich | |
| 3,050,295 | A | 8/1962 | Osgood | |
| 3,307,875 | A | 3/1967 | McDowell | |
| 3,841,707 | A * | 10/1974 | Kniff et al. | 299/84.1 |
| 3,954,301 | A | 5/1976 | Stepp | |
| 4,000,568 | A | 1/1977 | Donkers | |
| 4,244,625 | A | 1/1981 | Turner | |
| 4,432,584 | A | 2/1984 | Vartanov | |
| 4,717,206 | A * | 1/1988 | Sterwerf, Jr. | 299/82.1 |
| 4,765,072 | A * | 8/1988 | Schroeder | 37/465 |
| 5,248,188 | A * | 9/1993 | Walgren | 299/83.1 |
| 6,014,826 | A | 1/2000 | Walgren | |
| 6,397,501 | B1 | 6/2002 | Lembcke | |
| 6,405,852 | B1 * | 6/2002 | Christ | 198/802 |
| 6,421,938 | B1 * | 7/2002 | Kitanaka | 37/465 |
| 6,536,143 | B2 | 3/2003 | Lembcke | |
| 2002/0133985 | A1 | 9/2002 | Lembcke | |
| 2002/0139015 | A1 | 10/2002 | Lembcke | |

* cited by examiner

*Primary Examiner*—Glenn Dayoan
*Assistant Examiner*—John D. Walters
(74) *Attorney, Agent, or Firm*—Alan R. Stewart; Godfrey & Kahn, S.C.

(57) ABSTRACT

The present disclosure relates generally to improved chains for use with trenching machines. The present disclosure relates more specifically to a chain for a boomed trenching excavator, the chain including a plurality of links hingedly connected to each other. Each link includes a one piece body with an inner surface for engaging the boom and an outer surface for engaging the ground. Each link also includes a pair of side extensions for engaging a drive sprocket of the boom. One or more teeth may be mounted to the outer surface. The present disclosure also relates to a blank from which the links for an excavator chain may be made and to a link which may be used with other links to form an excavator chain.

14 Claims, 9 Drawing Sheets

PRIOR ART

PRIOR ART

TRENCHING MACHINE WITH LINKED CHAIN

CROSS-REFERENCE TO RELATED APPLICATIONS

The present application claims priority to U.S. Application Ser. No. 60/869,225, filed Dec. 8, 2006, the disclosure of which is incorporate herein by reference.

TECHNICAL FIELD

The present disclosure relates generally to trenching machines including one or more driven linked chains.

BACKGROUND

Conventional trenching machines have utilized linked chains or belts revolving about movable booms to excavate through rock and other earthen materials. Such conventional trenching machines may permit smooth sided trenches of up to six feet or more in width to be formed in the ground and may reach depths of up to thirty or more feet below ground level. The trenching machines are able to form these trenches through highly compacted soils or rock formations. However, trenching in such hard soils and rocks can cause a great deal of strain on the chains or belts actually doing the cutting.

Many conventional trenching machines are using chains or belts derived from tracked vehicle treads and track arrangements. While these have an advantage of being widely known and having good parts availability, these tracked vehicle treads and tracks are not optimized for use as a trenching tool. Various adaptations of these treads and tracks have been created over time to address some of these shortcomings, relating to durability and ease of maintenance and replacement. However, use of such vehicle derived treads and tracks as trenching tools still requires compromises in function, maintenance and operation.

Improvements to conventional trenching machines are desirable.

SUMMARY

The present disclosure relates generally to improved chains for use with trenching machines. The present disclosure relates more specifically to a chain for a boomed trenching excavator, the chain including a plurality of links hingedly connected to each other. Each link includes a one piece body with an inner surface for engaging the boom and an outer surface for engaging the ground. Each link also includes a pair of side extensions for engaging a drive sprocket of the boom. One or more teeth may be mounted to the outer surface. The present disclosure also relates to a blank from which the links for an excavator chain may be made and to a link which may be used with other links to form an excavator chain.

BRIEF DESCRIPTION OF THE DRAWINGS

The accompanying drawing figures, which are incorporated in and constitute a part of the description, illustrate several aspects of the invention and together with the description, serve to explain the principles of the invention. A brief description of the figures is as follows.

DETAILED DESCRIPTION

Conventional designs for rock trenching machine booms and linked chains extending about these booms have been adapted from existing crawler tracks for tracked vehicles, such as bulldozers. While these adapted tracks have worked reasonably well for trenching, some compromises have been accepted. Some of these compromises have been related to the design of the links which are linked together about the boom to build up the trenching chain. Other compromises relate to how the linked trenching chain is driven to move about the boom and how the chain is supported by the boom while it is moving and trenching. The present disclosure details a new design for chain links that addresses some of the compromises identified above.

Figure 1:
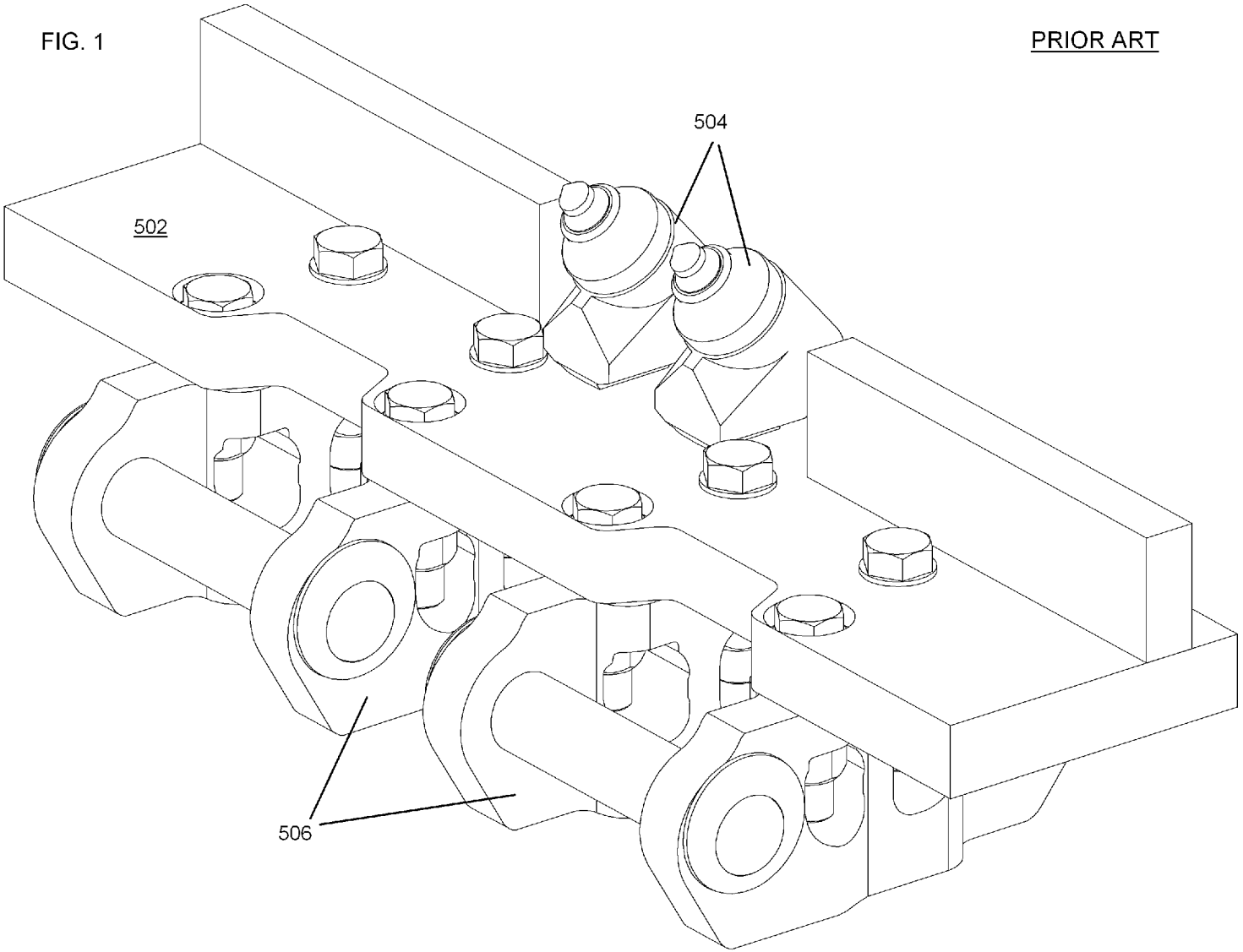
FIG. 1 is a perspective view of a portion of a prior art trenching chain.
Figure 2:
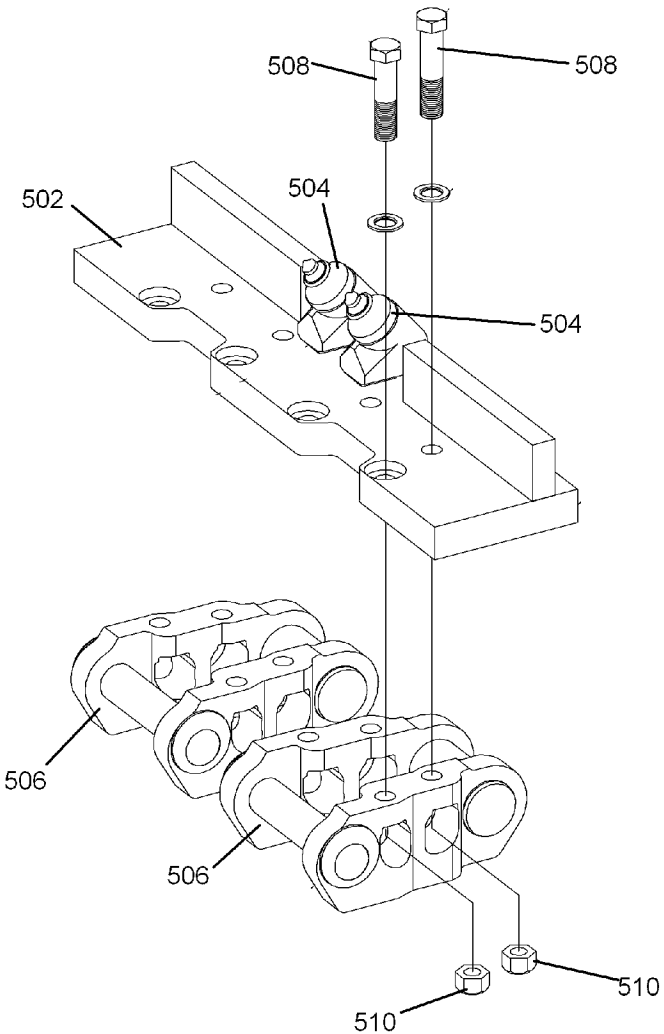
FIG. 2 is an exploded view of the prior art trenching chain of FIG. 1.

Conventional track designs for tracked vehicles and trenching booms include a chain with a driven linked belt to which chain pads or plates may be attached. A portion of a conventional trenching chain is shown in FIGS. 1 and 2, and includes a plate 502, with one or more teeth 504 mounted to an outer surface. One or more belts made up of a plurality of pivotably connected links 506 are engaged by and driven about a boom. The belt itself engages the drive and idler sprockets and is in contact with the body of the boom. Plates 502 may be bolted or otherwise removably attached to links 506 of the belt and engage the ground. For each plate, fasteners such as bolts 508 are required to mount to the belt. These fasteners 508 and their mating nuts 510 are exposed to tremendous stress and a very harsh operating environment. If the plates define a greater width than the belt(s), the plates may apply lateral and twisting stresses on the chain as the plates engage the ground. The number of parts comprising the chain is high, as the chain is comprised of parts to engage the ground and separate parts to engage the drive mechanism, as well as fasteners to connect the belt and plates to each other. Replacement of the driven linked belt requires removal or replacement of the chain pads or plates as well, and these parts may wear at different rates.

Conventional tracked systems for trenching may have a practical limit in the width they are able to effectively trench in a single pass. While chain pads or plates of different widths may be mounted to the belt, conventional trenching machines are not typically configured to mount belts of different widths. So the distance an outer end of a chain pad or plate extends from the driven linked belt may become unacceptably large for the machine, the ground through which the trench is being cut, or a combination of the two.

Figure 3:
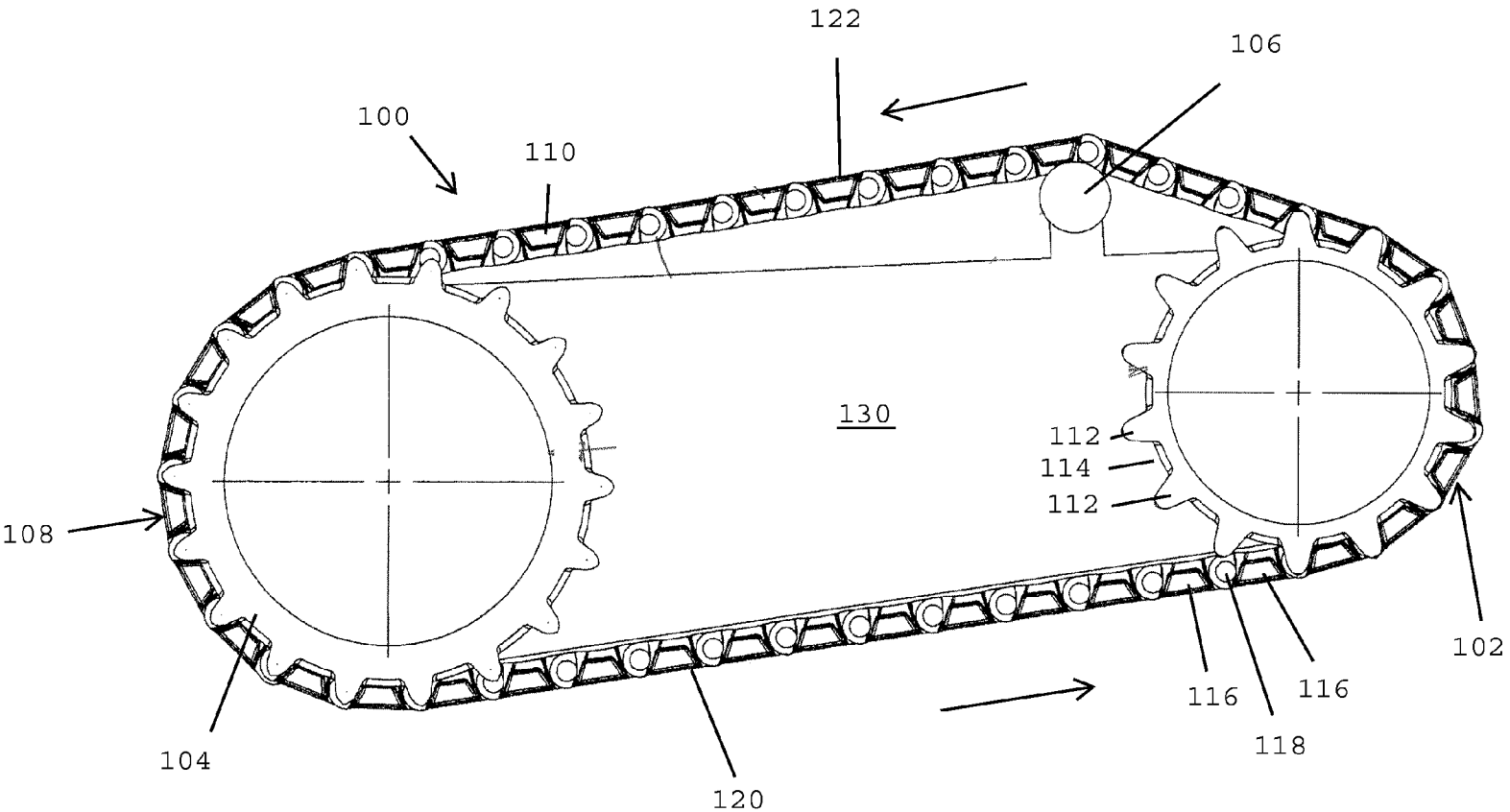
FIG. 3 is a side diagrammatic view of a boom for a trenching machine with a trenching chain according to the present disclosure.

In FIG. 3, a boom 100 according to the present disclosure may include at least one drive sprocket 102, at least one idler or tail wheel 104 at a distal end or tail 108 and an offset roller 106. A trenching chain 110 extends about boom 100 and roller 106 and engages both drive sprocket 102 and idler sprocket 104. In operation, a drive mechanism on a trenching machine chassis would be coupled to drive sprocket 102. The drive mechanism, such as but not limited to a separate, dedicated trenching chain drive motor or a power takeoff driven by a main motor of the trenching machine, would apply torque to drive sprocket 102. Drive sprocket 102 engages chain 110 and as drive sprocket 102 moves, chain 110 is moved about boom 100. Depending on the width of chain 110, there may be one or more drive sprockets 102 and/or idlers 104 to provide support across the width of the chain as the chain passes around either end of boom 100. Idler or tail wheel 104 is shown as a toothed wheel but may be configured without any such teeth within the scope of the present disclosure. It is not intended that idler 104 provide any motive or driving force to chain 110, so idler 104 need not have teeth to engage chain 110 as chain 110 passes over the idler.

The trenching machine may be equipped with a actuator that can raise and lower distal end 108 of boom 100 with respect to drive sprocket 102. This movement allows distal end 108 of boom 100 to be lowered to the desired depth of a trench. FIG. 3 is not shown to scale and is not intended to convey relative sizes or proportions. It is anticipated that trenches ranging in width from six inches to six feet or more, and depths of up to thirty feet or more, may be excavated using the trenching machine and trenching chain of the present disclosure.

Chain 110 extends about drive sprocket 102 and engages a plurality of teeth 112 of sprocket 102. Each tooth 112 may be spaced apart and define a generally uniformly sized gap 114. Chain 110 is comprised of a plurality of links 116 which are pivotably attached to each other by link pins 118. A portion of each link 116 between link pins 118 extends outward into space 114 between teeth 112 of sprocket 102 and the engagement of teeth 112 and links 116 permits drive sprocket 102 to move chain 110.

Idler 104 may be mounted at distal end 108 of boom 100 and may also include teeth 112 and spaces 114. Idler 104 may engage chain 110 in a similar fashion to drive sprocket 102 with the exception being that idler 104 will typically not be a drive sprocket. Idler 104 provides a turning point at distal end 108 about which chain 110 may be transitioned back toward drive sprocket 102. In normal operation, chain 110 would be driven by drive sprocket 102 so that a lower portion 120 of chain 110 is moving from idler 104 toward drive sprocket 102 and upper portion 122 is moving from drive sprocket 102 toward idler 104.

Referring to FIG. 3, upper portion 122 of chain 110 may pass over offset roller 106 as it transitions toward idler 104. Roller 106 may be offset by a distance from a body 130 of boom 100 and serves to hold at least some of upper portion 122 away from frame 130. This space between frame 130 and upper portion 122 of chain 110 may provide for improved clearing of trenching debris from the chain. The space between upper portion 122 of chain 110 and frame 130 may also reduce the friction in the movement of chain 110 about frame 130. Reduction in friction may aid in keeping chain 110 cooler during trenching operations and the space may permit better dissipation of heat from chain 110 during trenching operations.

Tensioning of chain 110 may be accomplished by extending or retracting boom 100 with respect to drive sprocket 102 to vary the distance between sprockets 102 and 104. For efficient operation, consistent tension on chain 110 within a specified range is desirable. This range of tension may vary with the size of the machine and the chain, as well as the type of chain and the soil or rock through which the chain is configured to trench. Variation of the tension during operation may be desirable, for example, as a chain 110 wears over usages, it may become elongated and too much slack may develop in the chain. This may result in a loss of tension as the chain passes over sprocket 102 and idler 104. This decreased tension may result in undesirable binding or wear of components, or may even permit chain 110 to become displaced from engagement of one or both of the sprocket and idler. Extending distal end 108 further away from sprocket 102 will permit tension on chain 110 to maintained within the desired range, even as wear occurs. When a worn chain 110 is replaced with a newer chain, distal end 108 may be moved back closer to sprocket 102 so that the new chain 110 won't be overly tensioned.

Figure 4:
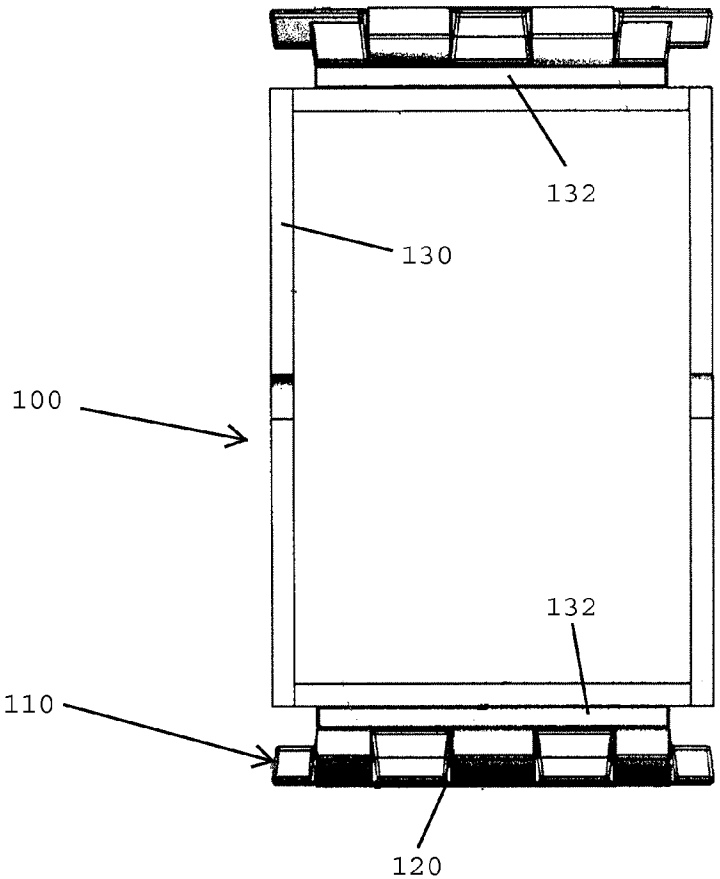
FIG. 4 is a cross-sectional view of the boom and chain of FIG. 3.

Also shown in FIG. 4, sacrificial wear strips 132 may be positioned to body 130 and may provide the surface over which chain 110 moves. When chain 110 is driven by sprocket 102 and lower portion 120 engages rock to be trenched, support to lower portion 120 must be provided so that chain 110 engages and cuts into the rock. However, if chain 110 is supported directly by and moves over body 130, the outer surface of body 130 may be worn down and replacement of the body may be necessary. Having sacrificial wear plates 132, body 130 is protected from direct contact and wear caused by chain 110. When plates 132 are sufficiently worn, the plates can be quickly and easily replaced without need to remove chain 110 from about boom 100.

The materials used to make body 130 and plates 132 may be selected based on different characteristics, which may or may not be compatible with each other. For example, the material of body 130 may be desirably strong and formable into the shape of body 130 and to resist deformation under load while boom 100 is used to trench through rock. However, such a material may not provide a particularly desirable surface for chain 110 to move across. Or the desirably rigid material may not be able to resist wear from chain movement. However, plates 132 may be chosen with a desirable toughness with respect to wear from chain 110 and may be with a desirably low resistance to movement of chain 110 over the plate. These material qualities may be selected without consideration of the suitability of the material for use in a structural member such as body 130.

Chain 110 may incorporate the driven elements that engage the sprocket, the idler and the boom with the elements which engage the ground. No fasteners are required to hold these two elements together. Drive sprocket 102 engages links 116 directly, instead of engaging a belt to which the chain pads or plates are attached. The engagement of sprocket 102 and links 116 occurs along an outer edge of links 116, rather than along a centrally mounted linked belt. Plates 132 can be sized to provide support across a greater portion of the width of links 116, as plates 132 are directly in contact with links 116 and are not providing support to merely a centrally mounted linked belt to which shoes are mounted.

The chain of the present disclosure allows for variable width booms and chains to be used and for each width of chain to be fully supported by the boom with a drive sprocket engaging the links along an outer edge of the chain.

Figure 5:
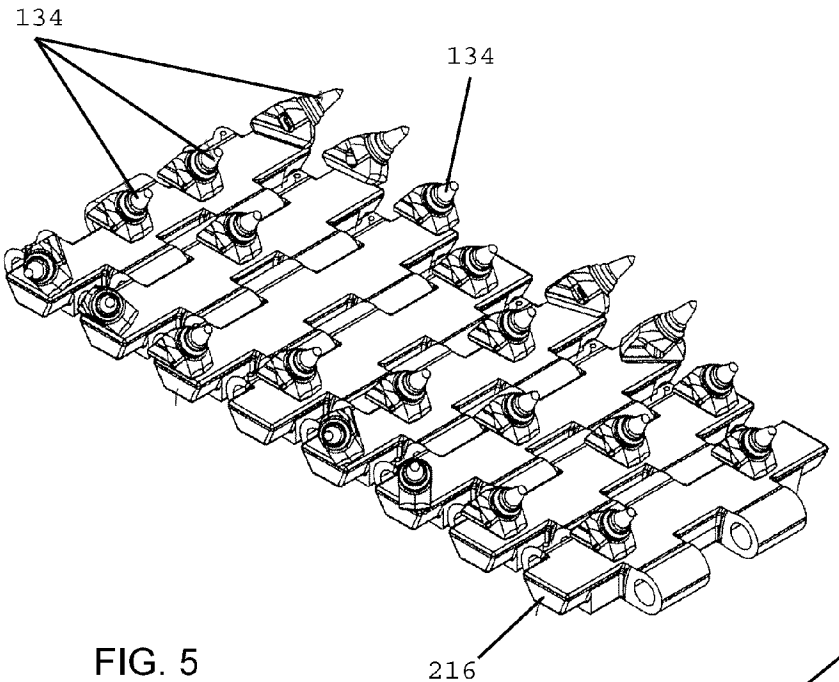
FIG. 5 is a perspective view of a portion of a trenching chain according to the present disclosure.
Figure 6:
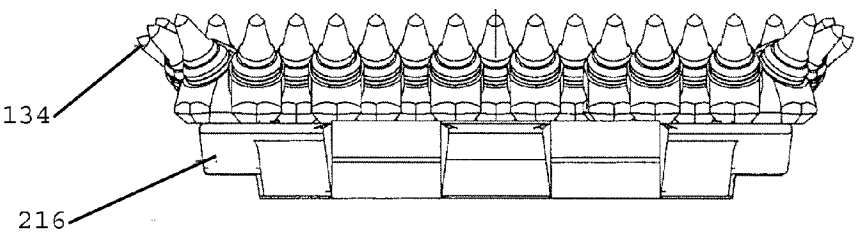
FIG. 6 is a top view of the trenching chain of FIG. 5.
Figure 7:
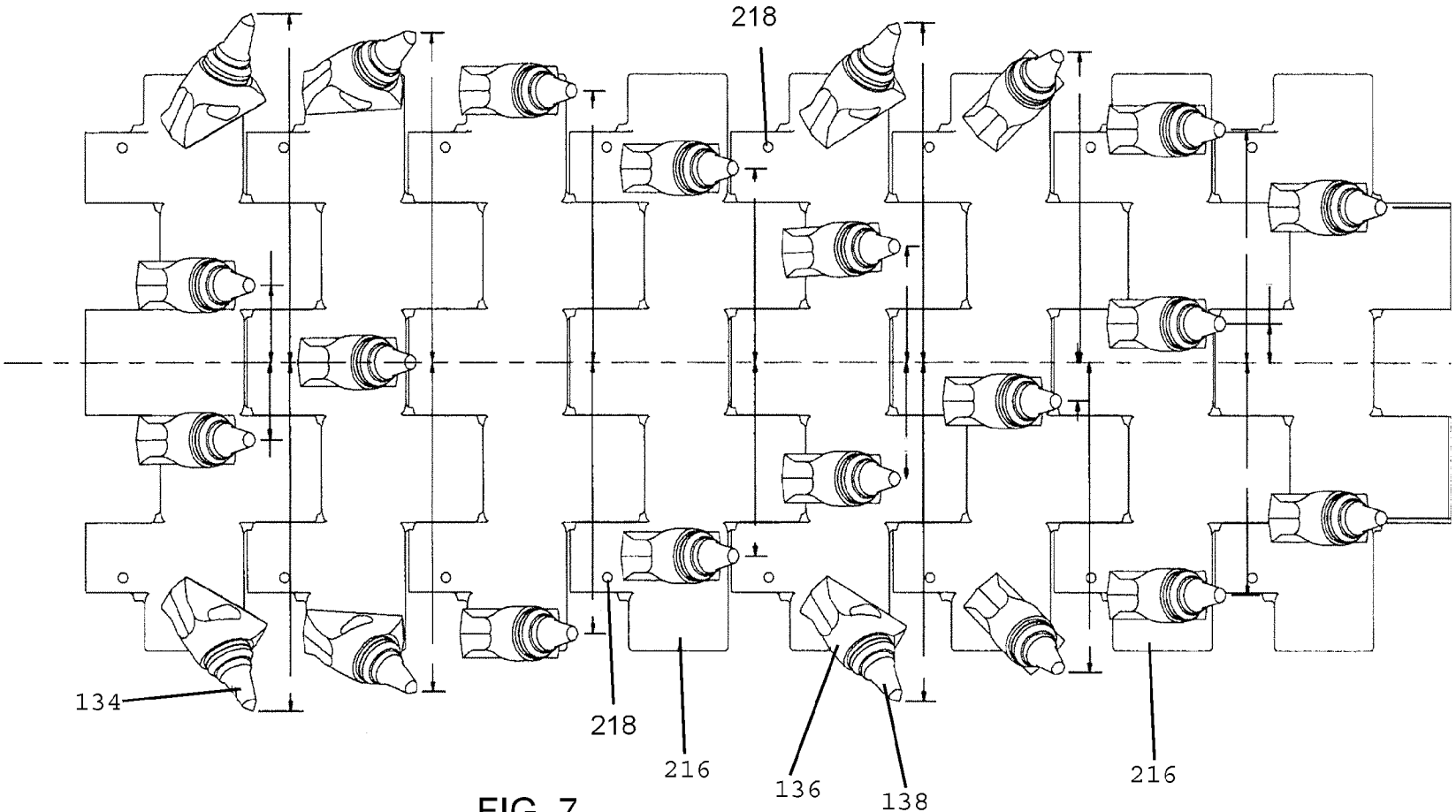
FIG. 7 is an end view of the trenching chain of FIG. 5.

Referring now to FIG. 5, a plurality of links 216 are shown with teeth 134 mounted on an outer surface. Teeth 116 may be placed in specific arrangements to provide the desired cutting width and to address particular soil or rock characteristics that are expected to be encountered during trenching. FIGS. 5 to 7 illustrate one particular array of teeth 134 that may be configured to extend the cutting width of a chain incorporating these teethed links 216 beyond the width of the links themselves. As shown, teeth 134 may comprise a mount 136 incorporated with or affixed to one of the links 216 and a replaceable tip 138 held by the mount. The use of teeth 134 in conjunction with links 216 allows one width of link 216 to be used to cut several widths of trenches, as the width cut can be extended beyond the width of the link and the boom by the arrangement of the teeth. Link pins 118 holding links 216 together may be held in position by a retaining pin 218 extending into each end of a link 216 and engaging each link pin 118 (see FIG. 3). It is anticipated that link pin 118 according to the present disclosure may be loosely fit to be essentially hand inserted, permitting easy pivoting of links 216 and movement of the chain about the boom. Retaining pins 218 permit such a loose fit while still keeping the link pins in the desired position.

Figure 8:
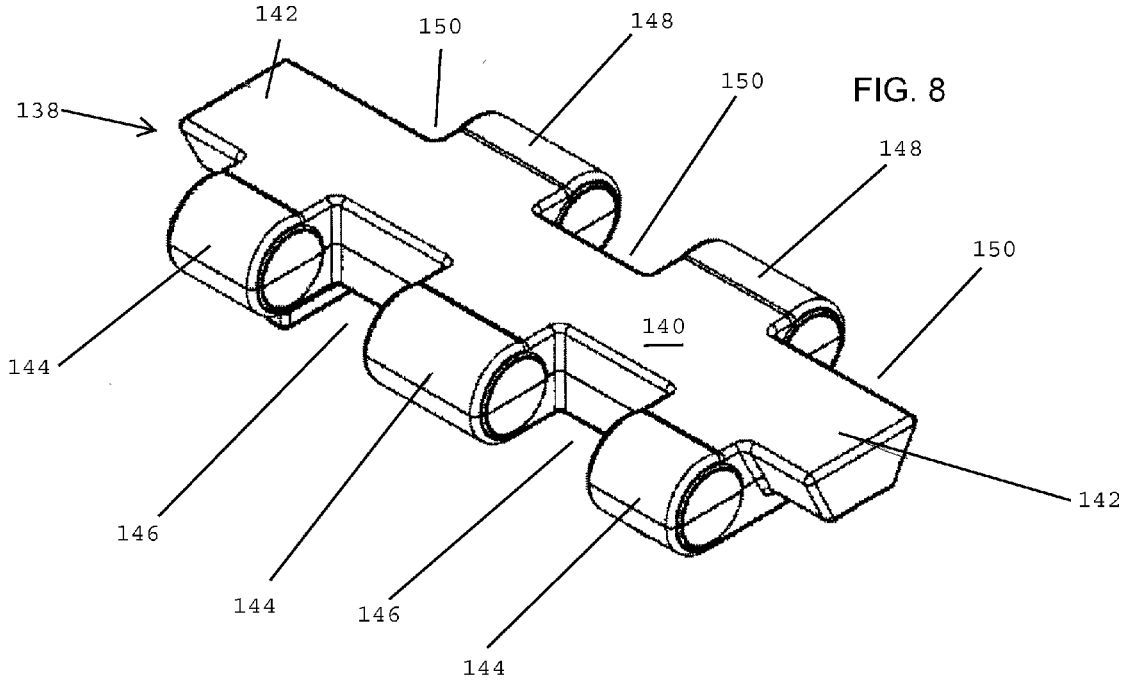
FIG. 8 is a first perspective view of a link of a trenching chain according to the present invention.

Referring now to FIG. 8, a blank 138 is shown that may be used to create link 116. Blank 138 may be formed by casting or forging. Blank 138 may include a pair of side extensions 142 sized to be received between teeth 112 of sprockets 102 and 104. Teeth 134 may be mounted to an outer surface 140. Blank 138 may be configured so that links 116 formed from the blanks may be engaged with each other and hingedly fixed with pin 118. On the front of blank 138 may be a plurality of journal lugs 144 into which may be formed openings to receive a pin 118. Journal lugs 144 define a plurality of openings 146 to receive journal lugs of an adjacent link 116. On the rear of blank 138 may be a second plurality of journal lugs 148 into which may be formed openings to receive a pin 118. Journal lugs 148 are sized to be received within opening 146 of an adjacent link 116. Journal lugs 148 are also positioned to define openings 150 to receive journal lugs 144 of an adjacent link 116.

Figure 9:
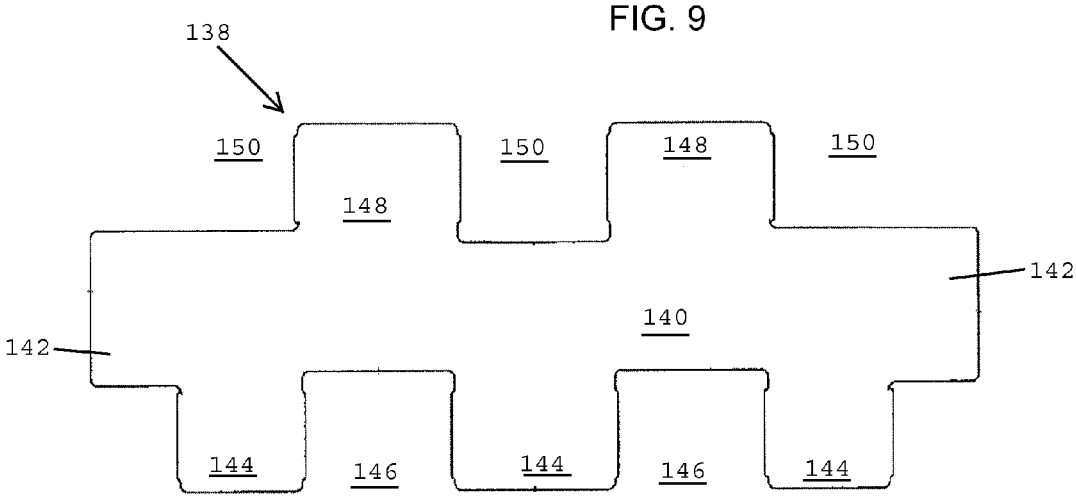
FIG. 9 is a top view of the trenching chain link of FIG. 8.
Figure 10:
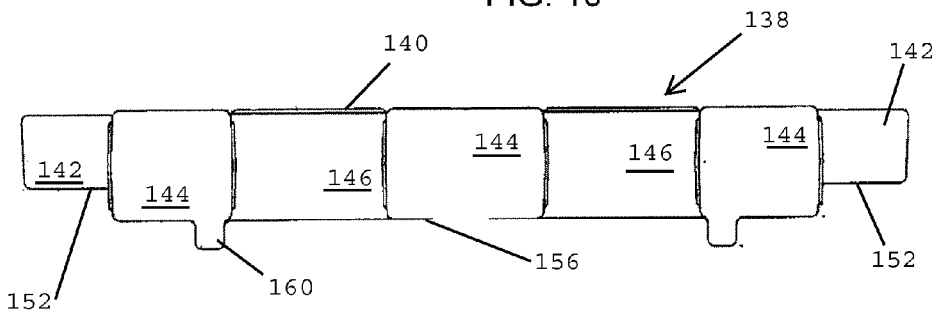
FIG. 10 is a front view of the trenching chain link of FIG. 8.
Figure 11:
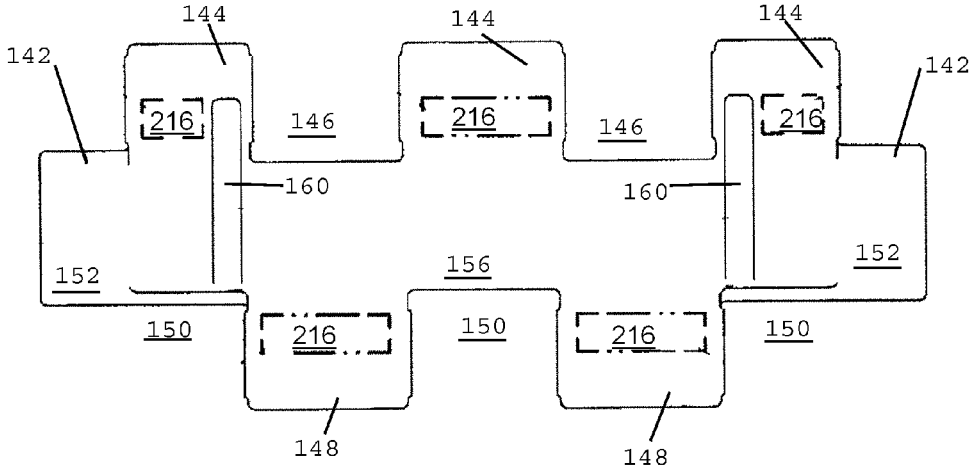
FIG. 11 is a bottom view of the trenching chain link of FIG. 8.

As shown in FIGS. 9 to 11, openings 146 and 150 on the front and back of blanks 138 are slightly too narrow in the raw form to receive journal lugs 144 and 148, respectively. Journal lugs 144 and 148 are intended to be formed to the proper size to engage each other in openings 146 and 150, respectively, by machining or some other similar process. By forming the oversized journal lugs in blanks 138, the lugs can be more precisely sized during the machining processes to closely match a specified size and tolerance than might be available by casting the lugs to the desired size. However, if forming processes for blank 138 can be improved with regard to size tolerances, and require less post-casting machining or forming for final fitting, then blank 138 may be formed closer to the desired finished size.

Figure 12:
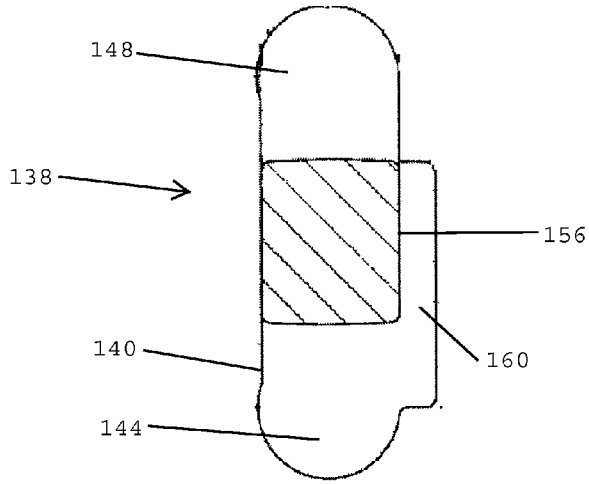
FIG. 12 is a first side view of the trenching chain link of FIG. 8.

Referring now to FIG. 12, side extension 142 defines an inner face 152 opposite outer surface 142 and a pair of walls 154 extend between the inner face and the outer surface. Walls 154 are shaped to engage teeth 112 of sprocket 102 and idler 104 as chain 110 bends around the sprocket and the idler. Walls 154 are shown as angled but the particular geometry of these walls may be determined based on the shape of teeth 112 and the diameters of sprocket 102 and idler 104. Note that inner face 152 of side extension 142 may be offset from an inner surface 156 of blank 138. This offset may allow sprockets 102 and 104 to extend alongside a shoulder 158 defined between inner face 152 and inner surface 156 and aid in the alignment or positioning of chain 110 as it passes over the sprocket or idler.

Figure 13:
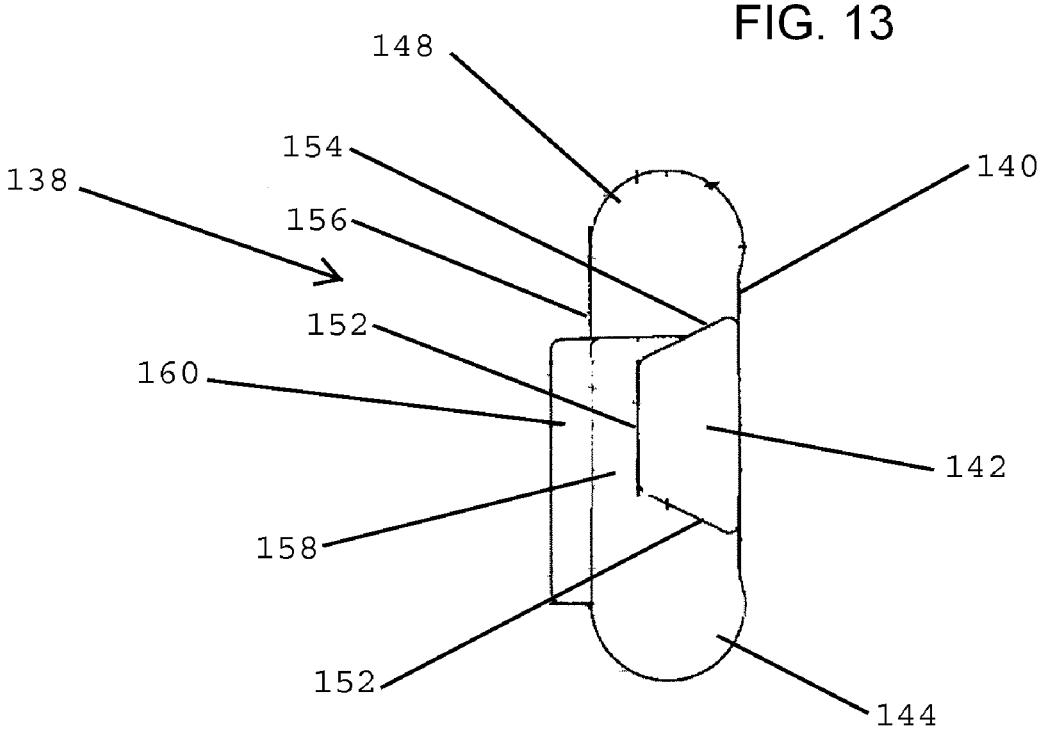
FIG. 13 is a second side view of the trenching chain link of FIG. 8.

As shown in FIG. 13, blank 138 may be full depth, i.e., extending between the inner and outer surfaces, between side extensions 142 to provide for more material and perhaps greater strength in the middle of link 116 machined from blank 138. A pair of guide tabs 160 are shown on blank 138 and may removed during the machining of blank 138 into link 116. Removal of guide tab 160 permits a plurality of bearing pads 162 along inner surface 156 to be defined to engage wear strips 132 of boom 100. Bearing pads may be slightly raised above inner surface 156 or may have different wear characteristics compared to the rest of inner surface 156.

Guide tabs 160 may be positioned along inner surface 156 of link 116 and not removed by machining to permit link 116 and a belt 110 made from links 116 to be used or retrofitted for use with existing conventional trenching machines or linked drive mechanisms. Guide tabs 160 may be spaced to ride along side channels or ridges of conventional booms that would engage belts of links 506 and guide chain 110 along a conventionally configured boom. Forming blanks 138 with guide tabs 160 permits forming of chains from links machined from the blanks for use as improved chains retrofit to existing machines or forming of chains 110 for use with booms 100 according to the present disclosure. Alternatively, blank 138 may be configured to not include any guide tabs 160.

What is claimed is:

1. A trenching chain for use with a boomed trenching excavator, the trenching excavator including a boom with a distal having an idler sprocket including a plurality of radially extending teeth, and a drive sprocket including a plurality of distally extending teeth mounted at an opposite end of the boom, the chain comprising:

a plurality of links pivotably attached to each other;

each link having a single piece body, the body of each link including a front and a rear, an inner surface and an outer surface, and a pair of opposing side extensions;

a plurality of lugs cooperating to define a plurality of openings between the lugs on the front of the body, a plurality of lugs cooperating to define a plurality of openings between the lugs on the rear of the body, the openings of the front configured to receive the lugs of the rear and the openings of the rear configured to receive the lugs of the front;

a pin extending through the lugs of adjacent links to hingedly connect adjacent links to each other;

the side extensions of each link extending beyond the lugs and sized to fit between and engage the teeth of the sprockets of the boom;

the inner surface of each link configured for engaging and passing along a boom of the trenching excavator, and an outer surface configured to engage the ground and form a trench when the chain is passed along the boom.

2. The trenching chain of claim 1, the outer surface of at least a portion of the links including a tooth configured to engage the ground and improve the ability of the chain to form a trench.

3. The trenching chain of claim 2, each tooth including a mount attached to the outer surface of the link and a replaceable tip secured in the mount.

4. The trenching chain of claim 2, further comprising every link including a tooth.

5. The trenching chain of claim 1, the inner surface of each link further comprising at least one raised portion configured to engage and ride along the boom as sacrificial wear pads.

6. The trenching chain of claim 1, the inner surface of each link further comprising at least one guide tab to engage the boom and aid in alignment of the chain as it passes about the boom.

7. The trenching chain of claim 1, further comprising at least one retaining pin extending through the outer surface of each link and engaging the pin connecting adjacent links.

8. A blank for use in making a link for a trenching chain, the blank comprising:

a front including a plurality of lugs cooperating to define a plurality of openings, and a rear including a plurality of lugs cooperating to define a plurality of openings, the number of lugs of the front matching the number of openings of the rear and the number of lugs of the rear matching the number of openings of the front;

an inner surface and an outer surface, the inner surface including at least a pair of guide tabs extending from the inner surface and at least one wear pad extending from the inner surface, the outer surface configured to receive at least one tooth for engaging the ground;

a pair of side extensions, the side extensions forming a portion of the outer surface of the blank and an inner face recessed with respect to the inner surface of the blank, the side extensions defining a side wall between the outer surface and the inner face, the sidewalls being sloped so that the side extensions are narrower at the inner face than at the outer surface.

9. The blank of claim 8, wherein the blank is formed by one of casting and forging.

10. The blank of claim 8, further comprising the openings of the front and rear of the blank defined by the lugs being too narrow for the insertion of lugs of the rear and the front of the blank, respectively.

11. The blank of claim 10, wherein the blank is a first blank and further comprising an identically configured second blank, and further comprising lugs of the front of the first blank are may be resized to closely fit within the openings of the rear of the second blank and the lugs of both the front and the rear of each blank configured to include an opening to receive a pin opening extending through the lugs to hingedly connect the first and second blanks.

12. The blank of claim 8, wherein the outer surface is configured to receive a plurality of teeth.

13. The blank of claim 8, wherein the inner surface of each lug includes a wear pad.

14. A link for a trenching chain for use with a boomed trenching excavator, the trenching excavator including a boom with a distal having an idler sprocket including a plurality of radially extending teeth, and a drive sprocket including a plurality of distally extending teeth mounted at an opposite end of the boom, the chain comprising a plurality of links pivotably attached to each other, the link comprising:

a single piece body including a front and a rear, an inner surface and an outer surface, and a pair of opposing side extensions;

a plurality of lugs cooperating to define a plurality of openings between the lugs on the front of the body, a plurality of lugs cooperating to define a plurality of openings between the lugs on the rear of the body, the openings of the front configured to receive the lugs of the rear and the openings of the rear configured to receive the lugs of the front;

the lugs configured to receive a pin extending which may extend through the lugs of adjacent links to hingedly connect adjacent links to each other to form the chain;

the side extensions of the link sized to fit between and engage the teeth of the sprockets of the boom;

the inner surface of the link configured for engaging and passing along a boom of the trenching excavator, and an outer surface configured to engage the ground and form a trench when the link is passed along the boom.

* * * * *